US007770741B2

(12) United States Patent
Oliver

(10) Patent No.: US 7,770,741 B2
(45) Date of Patent: Aug. 10, 2010

(54) SUPPORT RACK FOR EQUESTRIAN TACK

(76) Inventor: Carmen D. Oliver, 5008 West Oak Point Dr., Prior Lake, MN (US) 55372

( * ) Notice: Subject to any disclaimer, the term of this patent is extended or adjusted under 35 U.S.C. 154(b) by 580 days.

(21) Appl. No.: 11/592,797

(22) Filed: Nov. 3, 2006

(65) Prior Publication Data

US 2008/0105632 A1 May 8, 2008

(51) Int. Cl.
*A47F 7/00* (2006.01)

(52) U.S. Cl. ..... 211/85.11; 211/181.1

(58) Field of Classification Search ..... 211/86.01, 211/181.1, 85.31, 85.26, 106, 106.01, 113, 211/119, 85.11, 13.1, 105.1, 118; 248/215, 248/227.1, 227.4, 303, 309.1, 176.1, 213.4, 248/219.2, 227.3, 231.81, 538, 300; D6/467; D30/143, 134; 251/1; 256/1; 224/42.11, 224/430, 275, 925

See application file for complete search history.

(56) References Cited

U.S. PATENT DOCUMENTS 806,805 A * 12/1905 Hardin ..... 118/31
886,101 A * 4/1908 Ward ..... 118/31
D45,639 S * 4/1914 Lampe ..... D6/467
1,130,379 A * 3/1915 Collis ..... 118/31
1,179,349 A * 4/1916 Collis ..... 118/31
2,606,734 A * 8/1952 Magnuson ..... 248/215
2,632,613 A * 3/1953 Hack ..... 242/136
2,865,588 A * 12/1958 McCartney ..... 248/231.81
3,625,162 A * 12/1971 Crew ..... 108/47
3,799,507 A * 3/1974 Rizzo ..... 256/64
3,986,649 A * 10/1976 Heimstra ..... 224/567
3,998,332 A * 12/1976 Lambertson ..... 211/71.01
D262,334 S * 12/1981 Clarke et al. ..... D6/462
4,371,138 A * 2/1983 Roberts ..... 248/201
D277,515 S * 2/1985 Secor ..... D30/143
D280,048 S * 8/1985 Benedict ..... D6/328
D280,687 S * 9/1985 Baldridge ..... D6/512
D284,122 S * 6/1986 Kizen ..... D30/143
4,955,516 A * 9/1990 Satterfield ..... 224/414
D312,929 S * 12/1990 Nelson ..... D6/465
5,181,621 A * 1/1993 Plaehn ..... 211/88.01
5,271,540 A * 12/1993 Katz et al. ..... 224/430
5,615,783 A * 4/1997 Warnken ..... 211/118
5,845,951 A * 12/1998 Webb ..... 294/159
6,152,313 A * 11/2000 Klein et al. ..... 211/113
7,069,680 B1 * 7/2006 Crawford ..... 40/607.14
2004/0144818 A1 * 7/2004 Marhefka ..... 224/275
2008/0190873 A1 * 8/2008 Rockel ..... 211/119.011

* cited by examiner

*Primary Examiner*—Darnell M Jayne
*Assistant Examiner*—Stanton L Krycinski
(74) *Attorney, Agent, or Firm*—Antonio Papageorgiou

(57) ABSTRACT

A support rack for storing, organizing and managing tack is disclosed having a backbone, at least one support leg attached to the backbone for securing the support rack to a fence and at least one hook attached to the backbone for allowing tack to be placed on the hook and for receiving, supporting and organizing tack. The support rack may be placed over fence rails of a fence such as is typically found near show arenas or corrals or, in one embodiment, may be placed directly on a flat surface. As a result, the support rack for tack, particularly equine tack, is a unitized convenient means to organize, store and transport tack in an efficient manner.

12 Claims, 4 Drawing Sheets

SUPPORT RACK FOR EQUESTRIAN TACK

BACKGROUND OF THE INVENTION

1. Field of the Invention

This invention relates to a device for storing and organizing tack particularly tack used in conjunction with equine activities.

2. Description of Related Art

Showing and performing with horses, both as a hobby and a profession, has been popular in many cultures beginning in ancient times and continues until the present. Most riders own and use many forms of tack such as halters, bridles, lead ropes, reins and lunge lines. The multitude of tack is often taken to a show arena or corral for use while performing or working with horses in various activities.

Typically, the tack taken to the show arena or corral is not all used at the same time. When not in use, the tack is often stored on the ground, draped over a fence or hung on fences with make-shift plastic or home made hooks.

There is an additional problem of transporting tack to and from the show arena or corral. The most common solution to this transport problem is carrying tack in the hands or draped over the arms. This is often cumbersome and inefficient. When riding a horse to and from the show arena or corral, this means of transporting tack is nearly impossible to manage.

Transportable saddle rack and equipment carriers have become popular in recent years. U.S. Pat. No. 6,616,152 entitled, "Transportable Saddle Rack and Equipment Carrier" issued to Edward J. Oliver on Sep. 9, 2003, is an example. Devices such as this do not store and carry several pieces of rope, head stalls, and halters in an organized fashion. They are designed to provide ease of storage and organization of larger, heavier horse equipment.

At present, there is not, a smaller, durable, effective, way to store and carry necessary items such as: ropes, head stalls, halters, lariats, and lunge lines to and from the show arena or corral for purposes of use while training, showing, or performing.

From the foregoing it can be seen what is needed is a device for organizing equestrian tack with ease of use, structural integrity and transportability to store halters, bridles, lead ropes, reins, lunge lines and other tack.

SUMMARY OF THE INVENTION

A support rack for storing, organizing and managing tack is disclosed having a backbone, at least one support leg attached to the backbone for securing the support rack to a fence and at least one hook attached to the backbone for allowing tack to be placed on the hook and for receiving, supporting and organizing tack. The support rack may be placed over fence rails of a fence such as is typically found near show arenas or corrals or, in one embodiment, may be placed directly on a flat surface. As a result, the support rack for tack, particularly equine tack, is a unitized convenient means to organize, store and transport tack in an efficient manner.

It is therefore an object of the present invention in one or more embodiments to provide a device for efficiently organizing, storing or transporting tack particularly equine tack.

It is an object of the present invention in one or more embodiments to provide a device for restraining and constraining tack particularly equine tack.

It is an object of the present invention in one or more embodiments to provide a device for positioning tack particularly equine tack.

It is an object of the present invention in one or more embodiments to provide a device for organizing, storing, transporting, restraining, constraining or positioning tack particularly equine tack that is easy to manufacture.

It is an object of the present invention in one or more embodiments to provide a device for organizing, storing, transporting, restraining, constraining or positioning tack particularly equine tack that is easy to move from one location to another.

It is an object of the present invention in one or more embodiments to provide a device for organizing, storing, transporting, restraining, constraining or positioning tack particularly equine tack that is easy to position on a fence.

It is an object of the present invention in one or more embodiments to provide a device for organizing, storing, transporting, restraining, constraining or positioning tack particularly equine tack that is easy to use.

It is an object of the present invention in one or more embodiments to provide a device for organizing, storing, transporting, restraining, constraining or positioning tack particularity equine tack that is easy to use.

It is an object of the present invention in one or more embodiments to provide a device for organizing, storing, transporting, restraining, constraining or positioning tack particularly equine tack that is complementary to transportable saddle rack and equipment carriers.

These and other objects and advantages of the invention will be clear in view of the following description to the invention including the associated drawings.

BRIEF DESCRIPTION OF THE DRAWINGS

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

Figure 1:
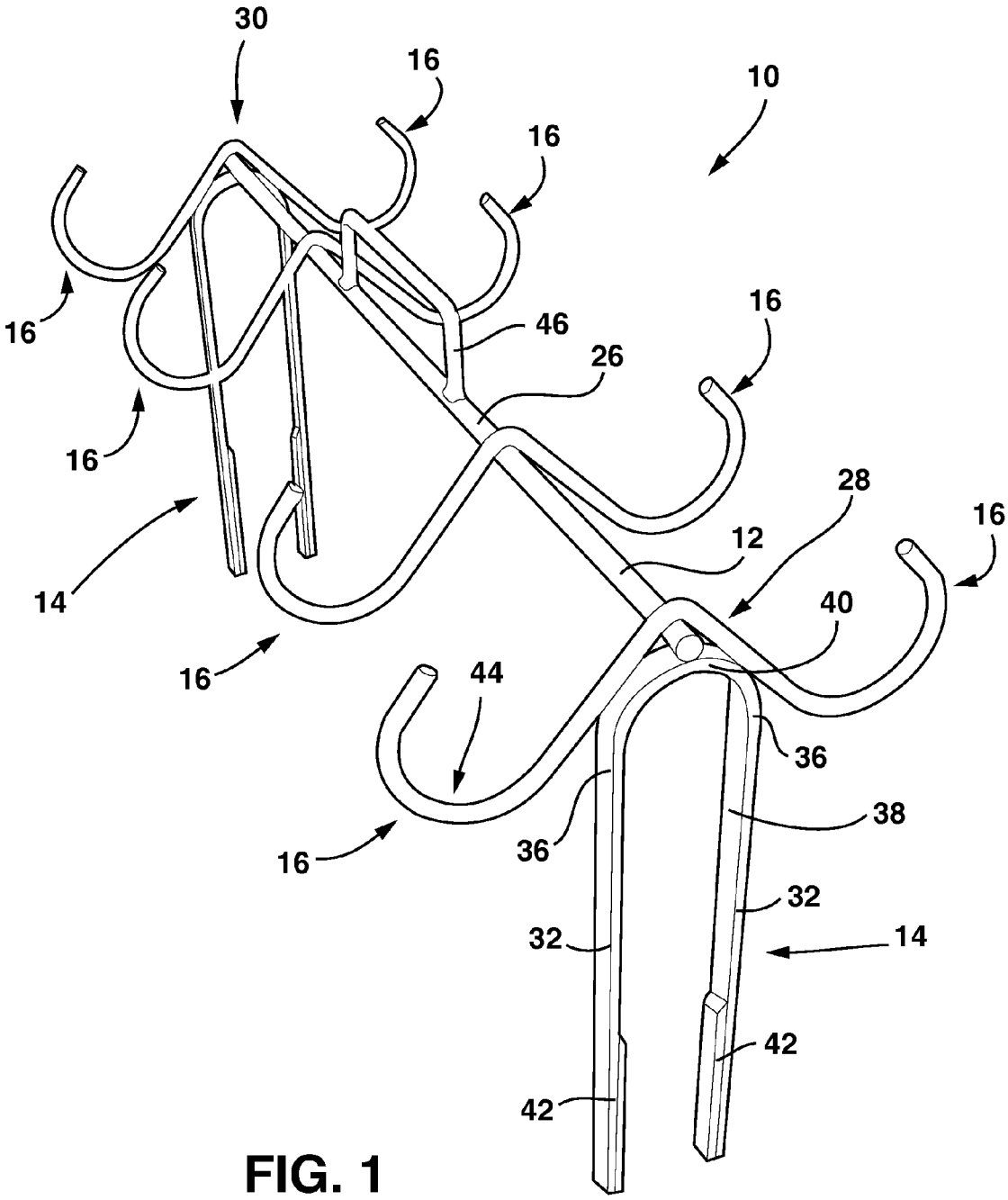
FIG. 1 is a perspective view of the support rack.
Figure 2:
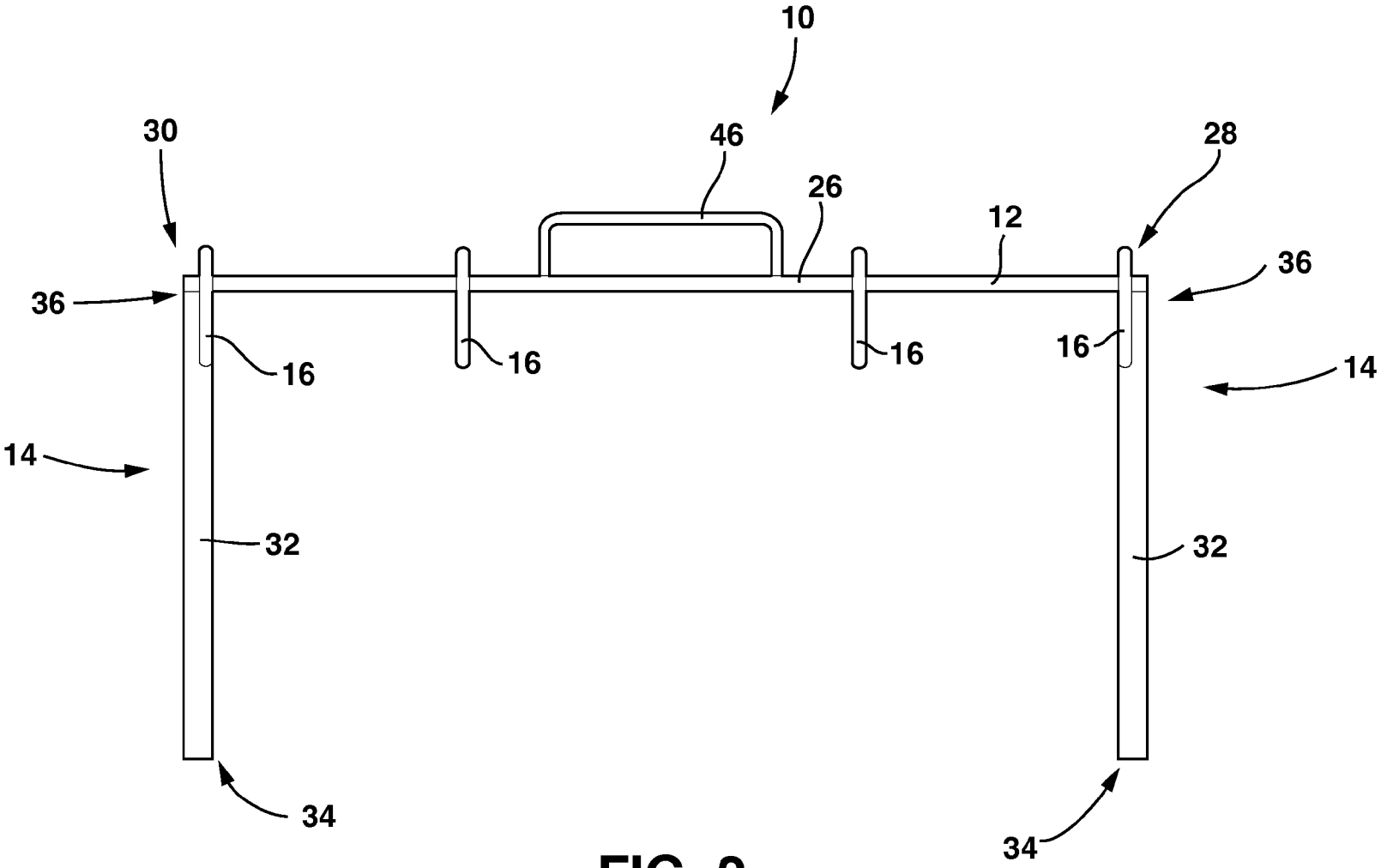
FIG. 2 is a front view of the support rack of FIG. 1.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

Where used in the various figures of the drawings, the same numerals designate the same or similar parts. Furthermore, when the terms "top", and "side", and similar terms are used herein, it should be understood that these terms have reference only to the structure shown in the drawings as it would appear to a person viewing the drawings and are utilized only to facilitate describing the preferred embodiments.

DETAILED DESCRIPTION OF THE INVENTION

In order that the invention may be clearly understood and readily carried into effect, a preferred embodiment of the invention will now be described, by way of example only, with reference to the accompanying drawings. The support rack of the present invention is shown in the drawings generally labeled 10. The support rack 10 includes a backbone 12, support legs 14 and hooks 16. The support rack 10 is particularly well adapted for use in conjunction with a fence 18 having a horizontal top fence rail 20 with an upper surface 22 and at least one horizontal lower fence rail 24. Fence 18 is typically a wooden or metal fence such as is typically found around horse corrals with top fence rail 20 and lower fence rail 24 typically having diameters of about two inches.

Figure 3:
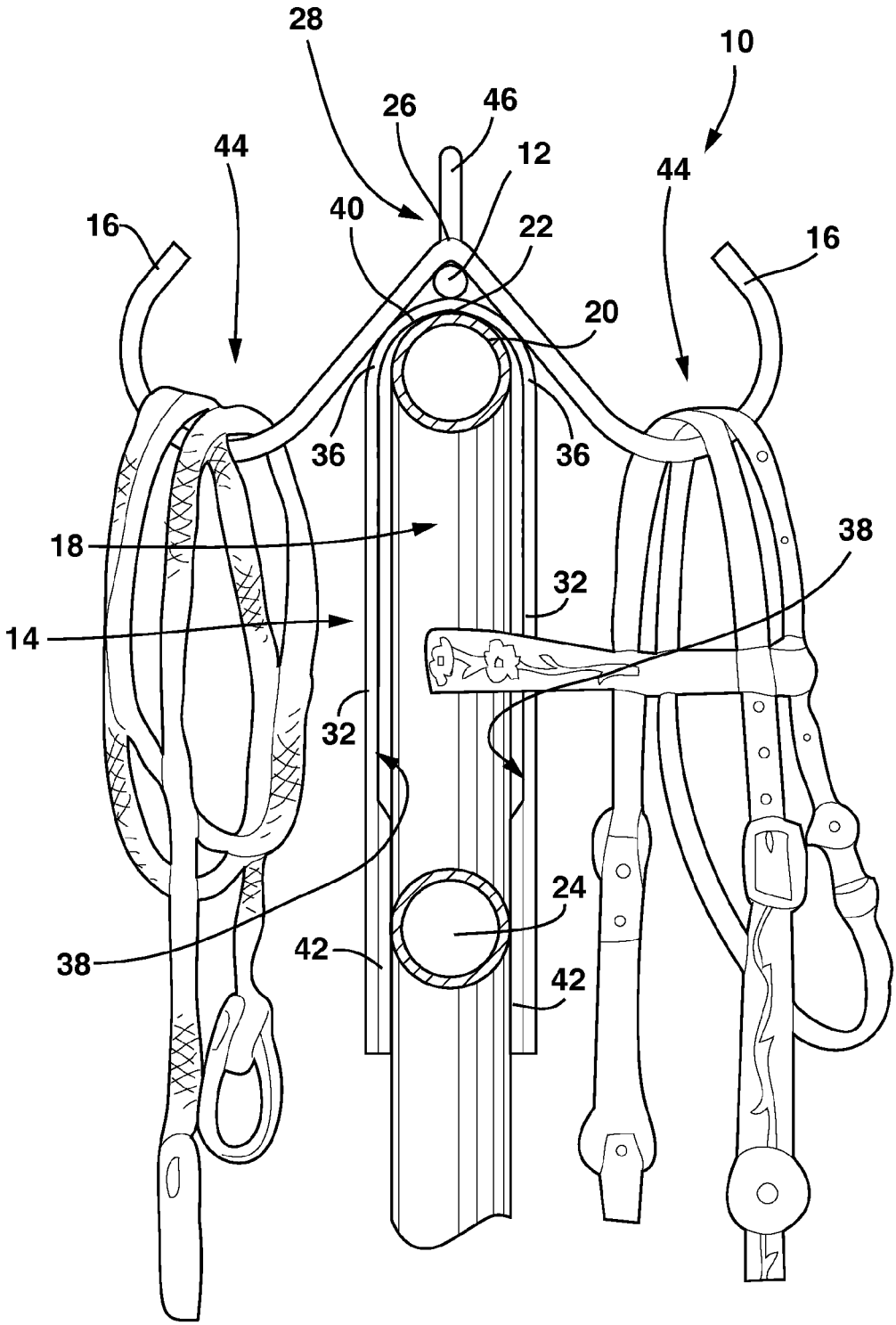
FIG. 3 is a side view of the support rack of FIGS. 1 and 2 in use on a fence with items of tack supported.
Figure 4:
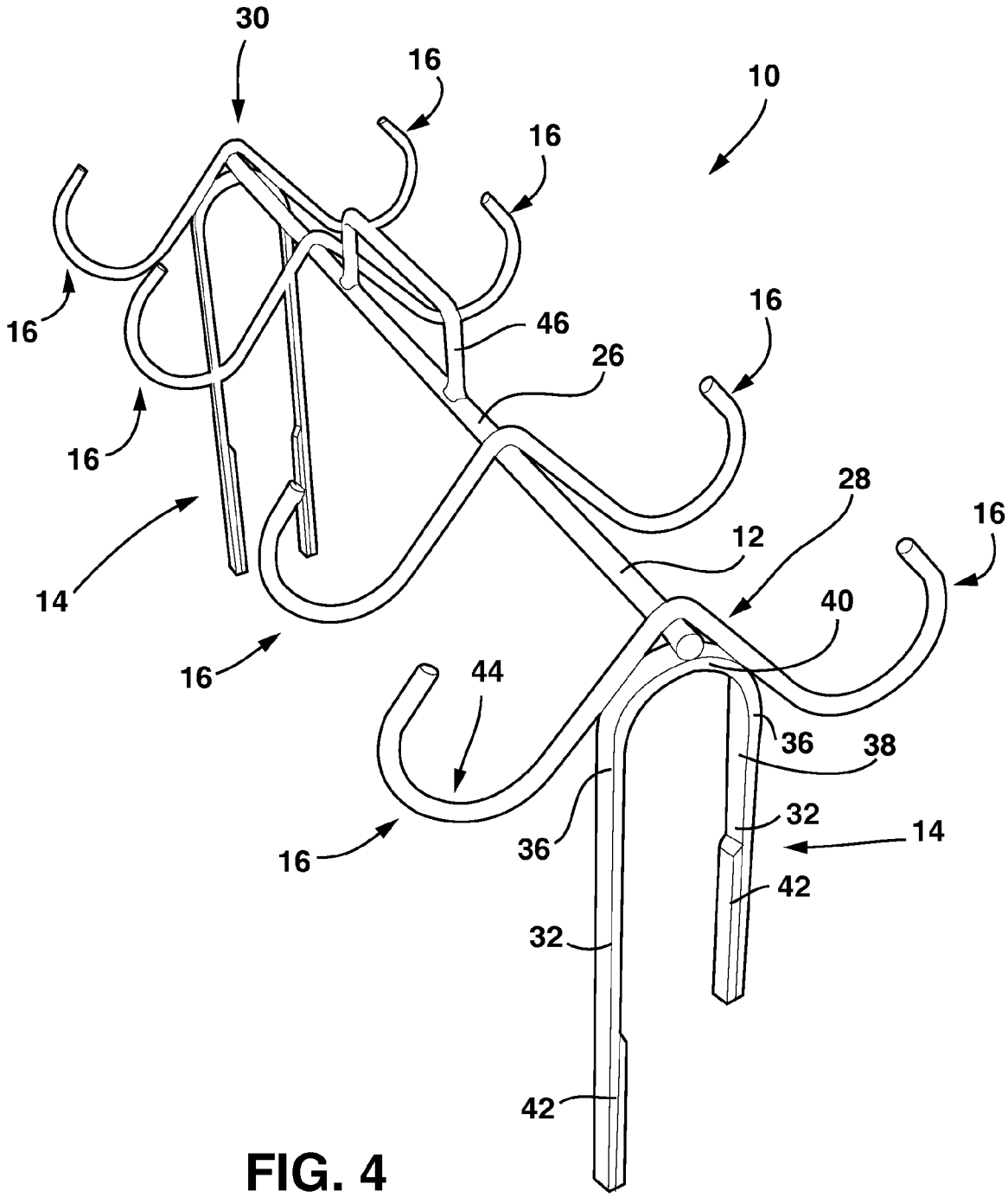
FIG. 4 is a perspective view of the support rack according to another embodiment of the support racks disclosed herein.

The backbone 12 preferably is substantially horizontal and has an upper surface 26, a first end 28 and a second end 30. Backbone 12 connects the support legs 14 which are each preferably located near the first end 28 and second end 30, respectively, of the backbone 12. In the preferred embodiment, backbone 12 is a single elongated piece of durable metal such asASTM-A36 hot rolled carbon steel or aluminum. In this embodiment, the backbone 12, when the support rack 10 is in use, rests on the upper surface 22 of the top fence rail 20. (FIG. 3) In the preferred embodiment, there is only one backbone 12 connecting support legs 14. However, there may be more than one backbone 12 extending between the support legs 14.

The support rack 10 includes at least one and preferably two or more support legs 14 attached to the backbone 12. Each support leg 14 preferably includes a pair of vertical legs 32 having a distal end 34, a proximal end 36 and an inner surface 38. The proximal ends 36 are attached to a connecting piece 40 which is preferably curved to match the curve of the upper surface 22 of the top fence rail 20. Each vertical leg 32 is spaced from its corresponding vertical leg 32 a distance about equal to the diameter of the top fence rail 20 or a lower fence rail 24. In the preferred embodiment of the invention, each vertical leg 32 has the same length and extends downward from the connecting piece 40 a distance sufficient that the distal ends 34 extend lower than the lower fence rail 24. In the preferred embodiment, the support legs 14 are made of a single piece of metal or other durable and rugged material that is formed into a substantially "U" shape having the dimensions described above.

In a preferred embodiment of the support rack 10, the inner surface 38 of the distal ends 34 of the vertical legs 32 have an inwardly directed gripping surface 42 located along the inner surface 38 of each vertical leg 32 in the area where the gripping surface 42 would contact a typical lower fence rail 24 when the support rack 10 is in use on a fence 18. The gripping surface 42 is preferably just an increased thickness of the distal ends 34 of the vertical legs 32. This increased thickness can be obtained by attaching additional material to the distal ends 34 of the vertical legs 32 on the inside surfaces of the distal ends 34 or forming the distal ends 34 of the vertical legs 32 with additional material on the inside surfaces of the distal ends 34.

Although the gripping surface 42 is preferably just an increased thickness of the distal ends 34 of the vertical legs 32, the gripping surface 42 may also include a textured surface allowing the gripping surface 42 to frictionally contact the lower fence rail 24. This testuring could take the form of ridges, bumps or protrusions from the gripping surface 42 or could include making or coating the gripping surface 42 of frictional material.

In the embodiment having gripping surfaces, the distance between gripping surfaces 42 is somewhat less than the diameter of a typical lower fence rail 24. Consequently, to locate the support rack 10 on a fence 18, the vertical legs 32 are placed on either side of the top fence rail 20 and moved downward so that the gripping surface 42 contact the lower fence rail 24. Because the distance between gripping surfaces 42 is somewhat less than the diameter of the lower fence rail 24, the gripping services 28 must be moved apart to locate the support rack 10. This is accomplished by downward pressure on the vertical legs 32 which forces the distal end 34 of each vertical leg 32 to splay apart to allow the gripping surfaces 42 to move over and into secure contact with the lower fence rail 24. This splaying causes an inwardly directed tension on the gripping services 28 what allow the gripping surfaces 42 to contact the outer surfaces of the lower fence rail 24 in a pinching motion thereby securing the distal ends 34 of the vertical legs 32 in secure contact with the lower fence rail 24.

In the preferred embodiment of the support rack 10, the vertical legs 32 located near the first end 28 and second end 30 of the backbone 12 are all of equal length. Because the preferred embodiment has vertical legs 32 of equal length, the support legs 14 form a support for the support rack 10. As a result, the support rack 10 may be placed directly on a hard surface such as the ground or a concrete surface where the support legs 14 through the vertical legs 32 will support and balance the support rack 10.

At least one hook 16 is attached to the backbone 12 and preferably several hooks 16 are attached to the backbone 12. Each hook 16 has an open part 44. The hooks 16 preferably extends away from the backbone 12 at about a 90° angle to the backbone 12. However, it is clear that hooks 16 can be attached to and extend away from the backbone at angles other than 90°. The purpose of the hooks 16 is to provide a mechanism for constraining and supporting the desired tack. Hooks 16 typically are oriented so that the open part 44 of the hooks 16 is directed upward so that tack may be placed on the hook 16 through the open part 44 and will settle by gravity into hook 16 where it is retained and constrained in contact with the hook 16.

In the preferred embodiment, a pair of opposed hooks 16 are formed from a single piece of metal that is attached to the backbone 12 preferably by welding. This produces hooks 16 that are mirror images of each other along the backbone 12. Although hooks 16 are preferably attached to backbone 12 by welding, hooks 16 maybe attached to backbone 12 by any other means well understood in the art including but not limited to clamping, pinching, nuts and bolts, screws or friction fit to give but a few examples. As mentioned above, in the preferred embodiment, several opposed hooks 16 are attached to backbone 12 spaced apart from each other along backbone 12. The spacing should be a sufficient distance to allow tack placed on one hook 16 to not interfere with tack placed on a neighboring hook 16. In addition, the hooks 16 are placed to not encumber the user while on foot or horse back.

In a preferred embodiment of the invention, the support rack 10 includes a handle 46 that is preferably attached to the upper surface 26 of the backbone 12. The function of handle 46 is to allow the user to grab the support rack by the handle 46 and easily move and position the support rack 10. In the preferred embodiment of the invention, handle 46 is a piece of elongated metal that is welded to the upper surface 26 of the backbone 12. However, handle 46 may be attached to the backbone 12 by any other means though occur to those skilled in the art including but not limited to clamping, pinching, nuts and bolts, screws or friction fit. In addition, the backbone 12 itself be formed in the shape of a handle 46 so that the backbone 12 itself performs the function of the handle 46.

In the preferred embodiment of the support rack 10, the backbone 12, hooks 16 and support legs 14 are made of a rugged, durable metal such as ASTM-A36 hot rolled carbon steel or aluminum and the respective parts are preferably attached to each other by welding. In this preferred embodiment, the metal may be either solid or tubular. However, the respective parts of the support rack 10 may be made of other rugged and durable metal or made, in whole or in part, of a rugged and durable non-metal such as plastic, fiberglass or graphite. In addition, the respective parts of the support rack 10 need not be attached to each other by welding. Instead, the respective parts of the support rack 10 may be connected by any means well understood in the art that allows the parts to be connected in a rigid and secure fashion.

Although the preferred embodiment of the invention has each vertical leg 32 having the same length, each vertical leg 32 is not required to be the same length. For example, one vertical leg 32 may have a length sufficiently long to position its distal end 34 into contact with a lower fence rail 24 while the other corresponding vertical leg 32 may not extend to the lower fence rail 24. In this embodiment, it is desirable to not place a hook 16 on the same side of the support rack 10 as the shorter vertical leg 32 since the torque applied to the support rack 10 by placing tack on such a hook 16 would not be transferred to the lower fence rail 24 through contact with the distal end 34 of the shorter vertical leg 32. As a result, the support rack 10 would rotate in the direction of the applied tack which is undesirable.

However, in this embodiment, tack could still be placed on a hook 16 located on the same side of the support rack 10 as the longer vertical leg 32 that contacts the lower fence rail 24. In this case, the torque applied to the support rack 10 by placing tack on such a hook 16 would be transferred to the lower fence rail 24 through contact with the distal end 34 of the shorter vertical leg 32. As a result, the support rack 10 would be constrained from rotating in the direction of the applied tack which would result in the tack being retained and constrained on the hook 16.

In use, the support rack 10 is taken to a desired location. The support rack 10 may be carried by the handle 46. If it is desired to place the support rack 10 on a fence 18, the support rack 10 is lifted so that distal ends of the vertical legs 32 pass on either side of the top fence rail 20 and move toward opposite sides of the lower fence rail 24. At this point, the gripping surfaces 42 will contact the outer surface of the lower fence rail 24. Moderate downward pressure is applied to the support rack 10 at the handle 46, along the backbone 12 or to the vertical legs 14 which pressure causes the distal ends 34 of the vertical legs 32 to splay apart and move past the lower fence rail 24 until the connecting piece 40 or the backbone 12 contacts the upper surface 22 of the top fence rail 20.

This contact between the upper surface 22 of the top fence rail 20 and the connecting piece 40 or the backbone 12 prevents the support rack 10 from moving further downward. The inwardly directed tension on the gripping surfaces 42 applied to the outside surface of the lower fence rail 24 secures the support rack 10 to the lower fence rail 24 while the proximal end 20 and the connecting piece 40 of the support legs 14 is in secure contact with the top fence rail 20. Thereafter, tack is placed on the hooks 16 by placing the tack through the open part 44 into contact with the hook 16. Torque caused by gravity pulling the tack downward on the hooks 16 is prevented from causing the support rack 10 to rotate in the direction of the tack by contact between the vertical legs 32 and the lower fence rails 26. As a result, the tack is securely supported on the hooks 16. With the support rack 10, a multitude of tack can be taken to the show arena or corral for its use and is kept off the ground and conveniently available to the user in an organized, open air manner.

The description contained herein is intended to be illustrative and not exhaustive. Many variations and alternatives of the described technique and method will occur to one of ordinary skill in this art. Variations in form to the component pieces described and shown in the drawings may be made as will occur to those skilled in the art. Further, although certain embodiments of a support rack 10 have been described, it is also within the scope of the invention to add other additional components such as loops, clips, snaps, buckles, brackets, and other fasteners to name but a few possibilities. All these alternatives and variations are intended to be included within the scope of the attached claims. Those familiar with the art may recognize other equivalents to the specific embodiments described herein which equivalents are also intended to be encompassed by the claims attached hereto. As a result, while the above description contains many specific elements, dimensions, functions and parameters, these should not be construed as limitations on the scope of the invention but rather as examples of different embodiments thereof. Many other variations are possible such as having more or less numbers of backbones 12, support legs 14, hooks 16 and handles 46. Accordingly, the scope of the invention should be determined not by the embodiments illustrated but by the appended claims and their legal equivalents.

I claim:

1. A support rack for tack, the support rack attachable to a fence, the support rack comprising:

a backbone having a first end and a second end;

at least one support leg for attaching the support rack to the fence, each support leg being securely attached to and extending away from the backbone, wherein each support leg includes a connecting piece and a pair of vertical legs attached to the connecting piece, each vertical leg having a distal end, a proximal end and an inner surface wherein each proximal end of each vertical leg is attached to the connecting piece and wherein the vertical legs are substantially parallel; and at least one hook attached to and extending away from the backbone, wherein the inner surface of the distal ends of the vertical legs have an inwardly directed gripping surface located along the inner surface of each vertical leg, and wherein the gripping surface is an increased thickness of the distal ends of the vertical legs so that the distance of separation between the proximal ends of the vertical legs of a support leg is larger than the distance of separation between the distal ends of the vertical legs of the support leg.

2. The support rack of claim 1 wherein the backbone is substantially horizontal.

3. The support rack of claim 1 wherein there are at least two support legs and wherein each support leg is attached to the backbone near a first end and a second end of the backbone respectively.

4. The support rack of claim 1 wherein each support leg is made of a single piece of material that is formed into a substantially "U" shape.

5. The support rack of claim 1 wherein the gripping surface includes a textured surface allowing the gripping surface to frictionally contact a lower fence rail when the support rack is in use on a fence.

6. The support rack of claim 1 wherein the vertical legs of a support leg are all of equal length.

7. The support rack of claim 1 wherein the at least one hook extends away from the backbone at about a 90° angle to the backbone.

8. The support rack of claim 1 wherein the at least one hook comprises a pair of opposed hooks.

9. The support rack of claim 8 wherein the pair of opposed hooks are formed from a single piece of metal that is attached to the backbone.

10. The support rack of claim 1 wherein the at least one hook comprises at least two opposed hooks attached to the backbone spaced apart from each other along the backbone.

11. The support rack of claim 1 further comprising a handle attached to or formed from the backbone to allow the user to grab the support rack by the handle and easily move and position the support rack.

12. The support rack of claim 1 wherein the backbone, at least one hook and at least one support leg are made of a rugged, durable material chosen from the group consisting of metal, plastic, fiberglass, and a combination of these.

* * * * *